United States Patent [19]

Hodgkins

[11] Patent Number: 4,860,713

[45] Date of Patent: Aug. 29, 1989

[54] BACK-TO-BACK FUEL FILTER AND WATER SEPARATOR

[75] Inventor: David H. Hodgkins, Granby, Conn.

[73] Assignee: Stanadyne Automotive Corp., Windsor, Conn.

[21] Appl. No.: 252,185

[22] Filed: Sep. 30, 1988

[51] Int. Cl.[4] ..... F02M 39/00

[52] U.S. Cl. ..... 123/510; 123/514

[58] Field of Search ..... 123/510, 511, 512, 513, 123/514, 516

[56] References Cited

U.S. PATENT DOCUMENTS

| | | | |
|---|---|---|---|
| 4,296,723 | 10/1981 | Aldrich | 123/514 |
| 4,372,847 | 2/1983 | Lewis | 123/510 |
| 4,543,938 | 10/1985 | Szlaba | 123/516 |
| 4,612,897 | 9/1986 | Davis | 123/514 |
| 4,617,116 | 10/1986 | Seiler | 123/514 |
| 4,795,556 | 1/1989 | Brotea | 123/510 |

FOREIGN PATENT DOCUMENTS

| | | | |
|---|---|---|---|
| 3308378 | 10/1983 | Fed. Rep. of Germany | 123/510 |
| 2530733 | 1/1984 | France | 123/510 |
| 0200657 | 12/1982 | Japan | 123/510 |
| 2140091 | 11/1984 | United Kingdom | 123/510 |

*Primary Examiner*—Carl Stuart Miller

*Attorney, Agent, or Firm*—Chilton, Alix & Van Kirk

[57] ABSTRACT

A fuel conditioner unit generally comprising a vertically oriented frame on either side of which are connected first and second filter housings, defining first and second filter chambers, for containing water separating and particle removing filter elements, respectively. An inlet is provided for introducing fuel from outside the unit to the first chamber, where water is separated and directed downwardly. The dewatered fuel is then transferred to the upper portion of the second chamber, where it moves downwardly over the particulate filter and is drawn out of the unit from an outlet port. A drain port is provided for discharging the water that is separated from the fuel in the first chamber. A vent can be provided in the upper portion of the second chamber for removing air that rises from the fuel as the fuel travels downwardly through the second chamber. In the preferred embodiment, the vent line from the first chamber and the drain line from the second chamber lead to the fuel tank, so that the air and water removed from the fuel are continuously returned to the fuel tank.

17 Claims, 4 Drawing Sheets

BACK-TO-BACK FUEL FILTER AND WATER SEPARATOR

BACKGROUND OF THE INVENTION

The present invention relates to apparatus for filtering and separating liquids, and more particularly, to a fuel conditioning apparatus for removing particulates and separating water from fuel in the fuel supply system for an internal combustion engine.

The practical necessity for conditioning fuel drawn from a fuel tank, prior to introduction into an internal combustion engine, is well known, particularly in diesel engine systems. One example of a known fuel conditioner is described in U.S. Pat. No. 4,491,120, "Fuel Conditioner". In this prior art device, a modular fuel conditioner has a base and a disposable filter-water separator cartridge releaseably secured to the base and defining a filter chamber in fluid communication with fuel inlet and outlet passageways in the base. A three stage filter assembly within the cartridge includes filtering and coalescing media and separates an upper portion of the chamber from a lower portion which defines a water collection sump. A heater in the base warms fuel before it enters the cartridge. Sensing devices in the base are provided for generating signals to indicate the presence of a predetermined quantity of water in the sump and the occurrence of a plugged filter condition. A priming pump on the base is manually operated to restore the fuel conditioner to operational condition after cartridge replacement.

SUMMARY OF THE INVENTION

It is an object of the present invention to perform the water separation and fuel particle filtering operations in physically separate chambers, while minimizing the complexity and manufacturing cost associated with supporting the separate chambers and providing the associated inlet, outlet, and transfer flow paths.

It is another object to provide such dual conditioning filter, wherein the frame, flowpath, and mounting structure for attachment to the vehicle, are integrally formed at low cost.

It is a further object of the invention to minimize, or eliminate, the need for air venting in the fuel conditioner, during either dry start-up or steady state operating conditions.

It is yet another object of the invention to minimize or eliminate the need for the vehicle operator to take positive action to drain the water that has been separated from the fuel in the fuel conditioner, while assuring that separated water cannot be delivered from the fuel conditioner to the engine.

These and other objects and advantages are accomplished in accordance with the invention, by a fuel conditioner unit generally comprising a vertically oriented frame on either side of which are connected first and second filter housings, defining first and second filter chambers, for containing water separating and particle removing filter elements, respectively. An inlet is provided for introducing fuel from outside the unit to the first chamber, where water is separated and directed downwardly. The dried fuel is then transferred to the upper portion of the second chamber, where it moves downwardly over the particulate filter and is drawn out of the unit from an outlet port. A drain port is provided for discharging the water that is separated from the fuel in the first chamber. A vent can be provided in the upper portion of the second chamber for removing air that rises from the fuel as the fuel travels downwardly through the second chamber.

In the preferred embodiment, the vent line from the first chamber and the drain line from the second chamber lead to the fuel tank, so that the air and water removed from the fuel are continuously returned to the fuel tank. This avoids relying on the operator's opening vents or drain plugs. Preferably, a water level sensor is provided in the first chamber at an elevation below the water drain conduit, such that a signal generated by the water sensor can alert the operator to the condition wherein water has accumulated to a predetermined level in the first chamber. The operator can decide whether to drain the water, or to continue permitting the separated water to be returned to the fuel tank.

As a result of the back-to-back arrangement of the chambers and filter elements, the water free fuel from the first chamber passes directly to a transfer conduit which leads to the fuel filter element. The fuel moves from the top to the bottom of the second chamber, passing through the particulate filter element. It is not necessary to remove the air during operation or even at engine start-up with a new filter because fuel entering the top of the element in the second chamber immediately flows or falls to the bottom of the element and continues on an uninterrupted path to the engine. Since air is lighter than fuel, the air always remains at the top of the element and is not drawn in the fuel outlet port at the bottom of the unit. Any accumulation of air disappears in time through adsorption into the fuel.

In ordinary filters where fuel enters the top and also exits the top of the filter chamber, the whole filter element must be filled with fuel before fuel can start flowing to the engine. Under these circumstances, venting is absolutely required or the injection system on the engine will become air-bound. The air vent in the present invention can be eliminated, but is optionally provided to speed the process of getting fuel to the filter on a completely dry installation. Once the fuel begins to enter the filter, the filter acts simply as a vertical bulge in the fuel line and does not require filling before going on to the engine.

BRIEF DESCRIPTION OF THE DRAWINGS

The preferred embodiment of the invention will be described below with reference to the company drawings, in which.

DESCRIPTION OF THE PREFERRED EMBODIMENT

Figure 2:
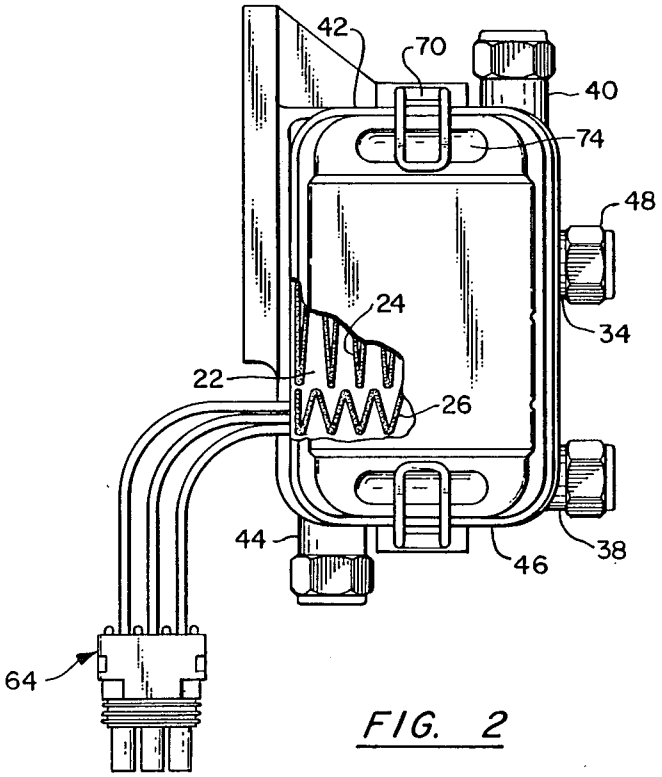
FIG. 2 is a side view, partly cut away, of the housing containing the particulate removal filter elements.
Figure 1:
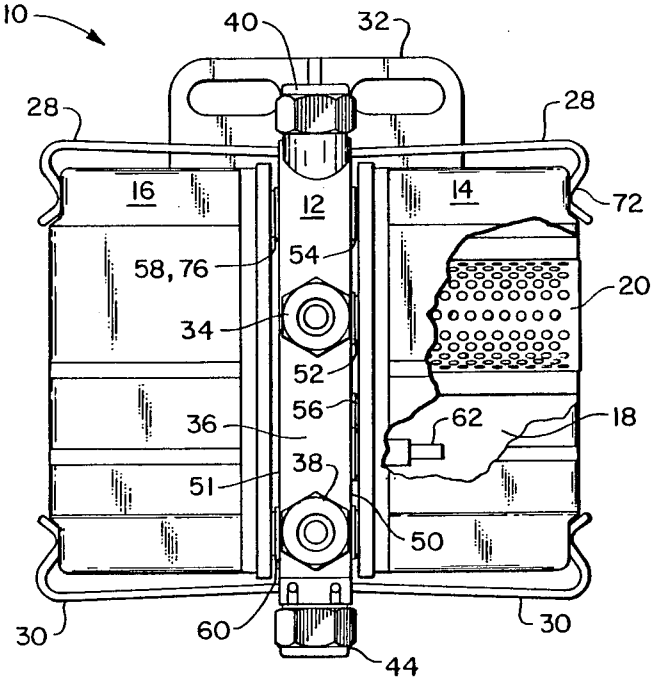
FIG. 1 is a front elevation view, partly cut away, of the dual conditioning filter in accordance with the invention.
Figure 3:
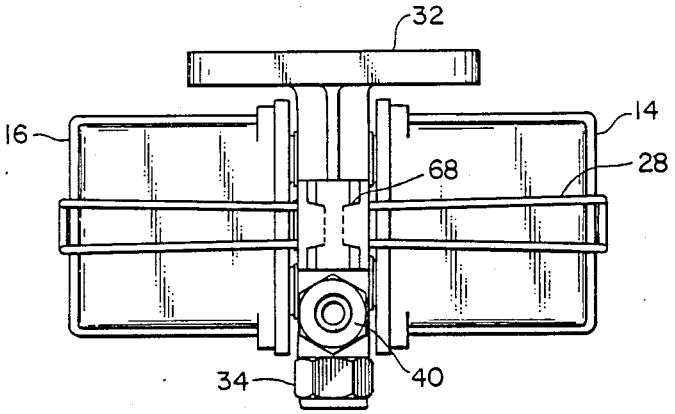
FIG. 3 is a top view of the conditioning unit shown in FIG. 1.
Figure 4:
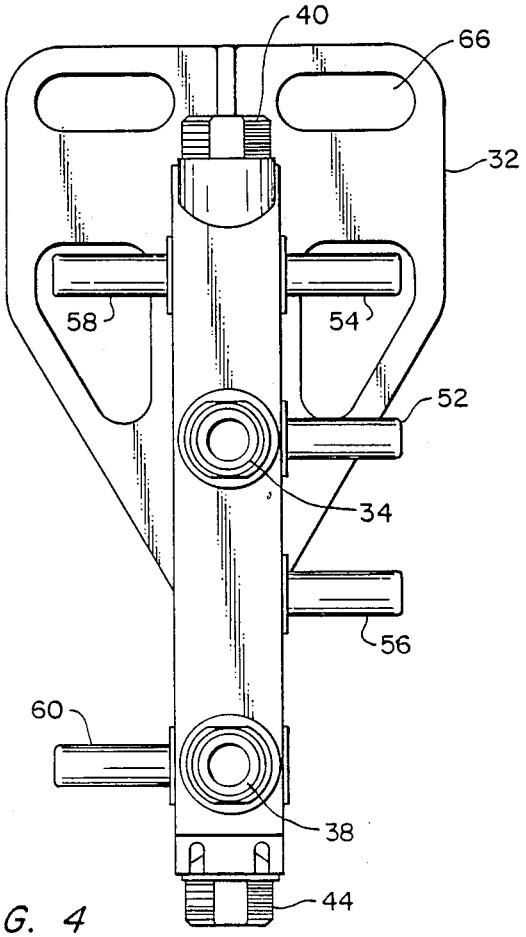
FIG. 4 is a front view similar to FIG. 1, with the filter housings removed to show the fluid conduits integrally formed on the central frame.

FIGS. 1–3 show a fuel conditioning unit 10 comprising a frame 12 and first and second filter housings 14, 16, connected on either side of the frame. The first housing 14 defines a first, substantially sealed chamber 18 in which is disposed a liquid separator element 20, and the second housing 16 defines a second, substantially sealed chamber 22 in which two stage particulate filter elements 24, 26 are located. The frame 12 is preferably substantially rectangular, as are the outer profiles of the housings 14, 16.

Frame 12 carries upper/clips 28 and lower/clips 30 which are pivotably mounted for selectively retaining or releasing the first and second housings 14, 16 onto the frame 12. A bracket 32 extends from the frame for connecting the unit to an engine or the like.

An inlet port 34 is preferably formed in the front 36 of the frame 12, and an outlet port 38 is preferably in the front of the frame, below the inlet port and substantially at the lower extent of the housings 14, 16. A vent port 40 is formed in the top 42 of the frame, and a drain port 44 is formed at the bottom 46 of the frame. The exterior projections of the ports are preferably threaded, and may include fitting 48. As viewed in FIG. 1, the frame 12 may be characterized as having a first side 50 and a second side 51, against which the first 14 and second 16 housings face, respectively.

As shown in FIGS. 3–6, the frame 12 is preferably integrally formed, including a plurality of conduits and the attachment bracket. An inlet conduit 52 is fluidly connected to inlet port 34 and projects from the first side 50 of frame 12. Transfer conduit 54 provides a flow path leading from the first side of the frame into the frame, and similarly, a drain conduit 56 provides a flow-path from the first side of the frame into the frame. Another transfer conduit 58 is fluidly connected through the frame 12 with the first transfer conduit 54. Outlet conduit 60 projects from the second side of the frame and is fluidly connected to the outlet port 38.

Figure 6:
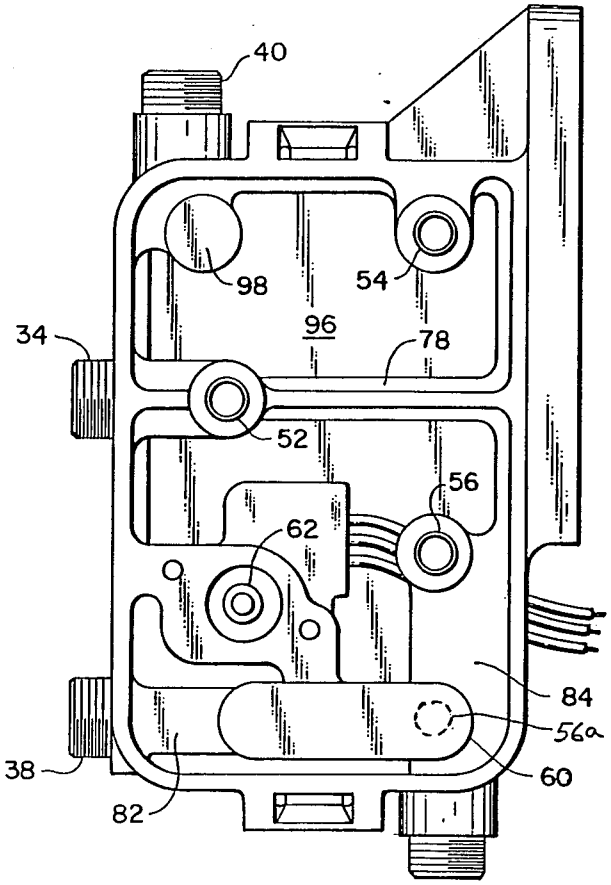
FIG. 6 is a side elevation view similar to FIG. 5, showing the first side of the frame element with the second housing containing the water separating filter element removed.

The frame also incorporates integral vent conduit 98. As is shown in FIGS. 1 and 6, a water level sensor 62 can be fitted to the frame for projecting into the first housing. As shown in FIGS. 2 and 6 circuitry including lines and signal generators, indicated generally at 64, are adapted to pass into the frame 12 and convert electrically to the sensor 62.

The bracket 32 preferably includes a plurality of mounting holes 66. The top 42 and bottom 46 of the frame 12 preferably have clip/mounts 68 integrally formed there in for receiving the clips 28, 30, and recesses 70 which permit the pivotal, vertical movement there of. Each clip has a detent 72 for engaging a notch 74 on a respective housing out outer surface.

Figure 5:
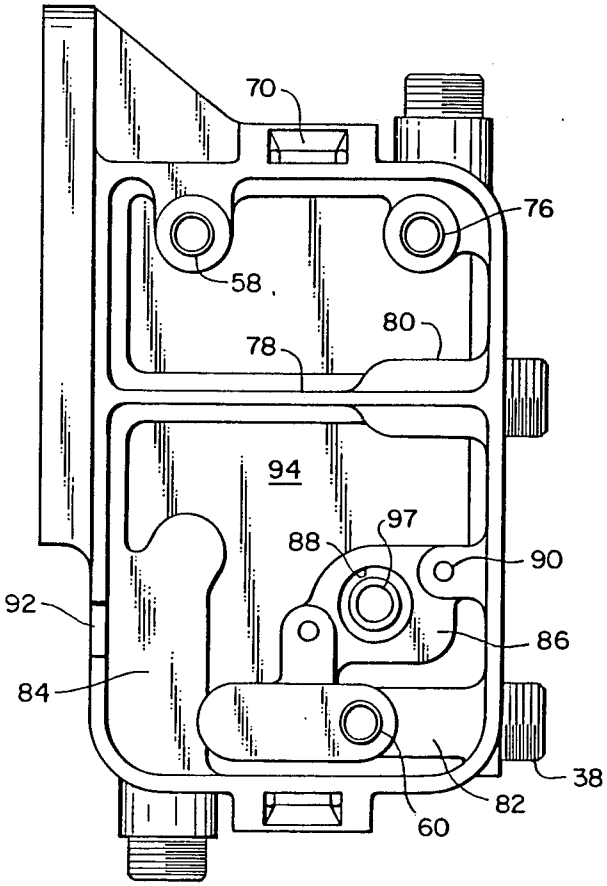
FIG. 5 is a side elevation view similar to FIG. 2, with the first housing containing the particulate removal filter element, removed to expose the second side of the frame.

As shown in FIGS. 5 and 6, a vent conduit 76 projects from the second side of frame 12 and is fluidly connected through the frame to the vent port 40. A transverse rib 78 integrally spans the front and back of the frame 12, with the forward portion 80 forming an integral inlet conduit in the frame. Similarly, portion 82 forms an integral outlet conduit and portion 84 forms an integral drain conduit, leading to outlet port 38 and drain port 44, respectively.

Within the frame 12, a sensor mount 86 defines a mounting bore 88 and provides locations 94 for fastening sensor 62 to the frame 12. The sensor mount 86 is also preferably integrally formed in the frame 12. A notch 92 on the second side of the frame 12 is conveniently provided for accommodating the wires of circuitry 64. In FIG. 5, the first housing wall 94 is visible through the open regions of the frame, and in FIG. 6 the second housing wall 96 is similarly visible. In FIG. 5, the sensor 62 is not shown, but the sensor receiving hole 97 in the first housing wall is visible through mounting bore 88. Sensor 62 is visible through mounting board 88 in FIG. 6.

It should be appreciated in that the first and second housing walls 94, 96, have a plurality of holes for sealingly receiving the various conduits 52, 54, 56, 58, 60, and 76. The receiving holes in the housings are formed with a grommet or similar flexible sealing surface, as is known in this field of technology.

Figure 7:
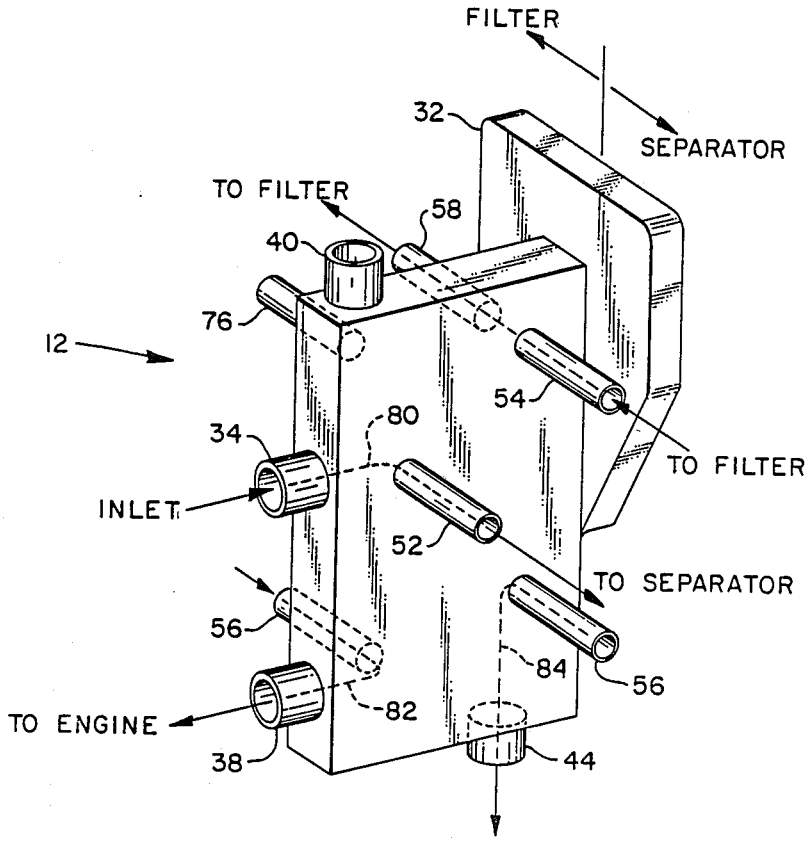
FIG. 7 is a schematic representation of the various ports and flow conduits associated with the frame.
Figure 8:
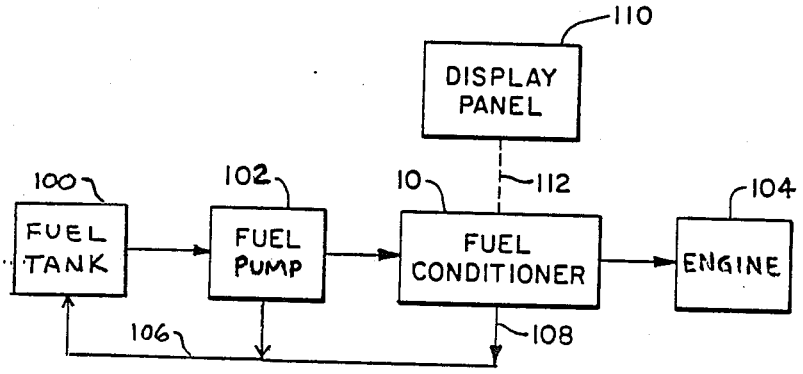
FIG. 8 is a block diagram showing the preferred water return arrangement.

As shown schematically in FIGS. 7 and 8 the flow path of fuel from the tank 100 enters the conditioning unit through fuel inlet port 34, passes through the integral conduit 79 and the inlet conduit 52 from which the fuel is discharged into the water separator chamber 18. The water passes vertically from above through the coalescing element, which is typically an extruded polyester fiber cylinder. As the water is coalesced out of the fuel, the water droplets fall to the bottom of the chamber because of their higher density, and clean, water-free fuel passes out of the first chamber through transfer conduits 54, 58 into the upper portion of the second chamber. The water-free fuel moves from top to bottom through the particulate filter elements, typically filter paper. The water-free, particle free fuel then enters the drain conduit 56, passes through integral conduit 82 and is delivered to the engine through outlet port 38. Air which may accumulate in the upper portion of the second chamber is extracted through a vent conduit 76 and air vent port 40.

The removal of water resulting from operation of the coalescing filter, is described with reference to FIGS. 1, 6 and 8. As the water collects in the bottom of the first chamber 18, it rises until it reaches the level of the water sensing probe 62 at which time the circuitry 64 generates a signal 112 that is visible to the operator on a display panel 110, so that the operator knows he has water in his fuel. Two different arrangements for removal of water can be used with the present invention. If the conditioning unit is located on a vacuum system where the filter is in a low pressure condition, the water will not drain unless air is allowed to enter the chamber. The operator can open drain port 44, which enables water to pass through drain conduit 56 and integral drain conduit 84. If complete draining is desired, drain conduit 56 can be located at an elevation below the sensor 62, as shown in phantom at **56*a* in FIG. 6. If the conditioning unit 1? is installed on a pressurized fuel system, this arrangement can work quite satisfactorily as the space made up by draining the water is recharged with fuel by the pressurizing source. In accordance with the preferred embodiment for use in pressurized systems, a small, constant drain orifice is provided by the drain conduit 56, at a level above the sensing probe 62. When the water level reaches the sensing probe, the operator is notified via display panel 110. When the water level reaches the drain conduit 56, the flow path from the drain port 44 returns to the fuel tank 100**.

In overview, fuel from the fuel tank 100 is delivered to the fuel pump 102, passed through the conditioning unit 10, and from there to the engine 104. Conventionally, excess fuel associated with the operation of the fuel pump is returned via line 106 to the fuel tank 100. In accordance with the invention, the fluid draining through conduit 56, 84, and port 44, is continuously passed through line 108 into line 106 and thus returned to fuel tank 100. Under normal circumstances, the fluid flow is dry fuel. If water is present to the degree that it reaches the drain conduit 56, then this water is transferred back to the fuel tank 100 from where it first came. This feature prevents water from ever reaching the engine 104, thus giving the ultimate in protection, whether or not the operator takes positive action to drain the water from the fuel tank 100 or the conditioning unit 10.

The size of the sump or collection region below the coalescing filter 20 in the first chamber 18, is immaterial to the invention. The particular location of the water sensor 62 is dependant upon the type of desired warning of water conditions. An early, continuous signal presence will occur if the sensor is placed low in the collection region. If the sensor is placed relatively high in the collection region, the operator will be notified only when a substantial accumulation of water has occurred. The constant return orifice through conduit 56 will be located above the probe 62 if the operator is to be warned of the water accumulation. It should be appreciated, however, that the warning to the operator is not necessary when the conditioning unit is fitted with the constant water return line 108 as depicted in FIG. 8.

In the preferred embodiment as described, the ports and conduits are all integrally associated with frame 12, whereas the filtering occurs in self-sealed, self contained housing members 14, 16. One or more additional embodiments of the invention could include porting through one or more of the housings, or sealing of the housing against the frame in some manner other than through the grommet holes in the housing walls 94, 96. The claims appended here to, rather than the particular embodiments shown in the accompanying drawings, define the spirit and scope of the invention.

I claim:

1. A fuel conditioning unit comprising:

a vertically oriented frame;

a first filter housing connected to a first side of the frame and defining a first filter chamber for containing a first filter element adapted to separate water from fuel;

a second filter housing connected to the second side of the frame and defining a second filter chamber containing a second filter element adapted to remove particulates from fuel;

inlet means for introducing fuel from outside the unit to the first chamber;

means associated with the frame for conveying fuel that is filtered through the first chamber to the upper portion to the second chamber;

outlet means for drawing fuel out of the unit from a lower portion of the second chamber; and drain means for discharging from the unit, water that is separated from fuel in the first chamber.

2. The fuel conditioning unit of claim 1, wherein the inlet means includes an inlet port in said frame and an inlet conduit projecting from the frame into the first chamber, and the outlet means includes an outlet conduit projecting from the frame and leading from the second chamber to an outlet port in said frame.

3. A fuel conditioning unit of claim 1, wherein the means for conveying fuel from the first to the second chamber includes a through bore in the frame between the first and the second chambers.

4. The fuel conditioning unit of claim 2, wherein the inlet conduit and the outlet conduit are integral with the frame.

5. The fuel conditioning unit claim 3, wherein the means for conveying further includes first and second transfer conduits integrally formed on the frame, for transferring fluid from the first chamber through the bore and into the second chamber.

6. The fuel conditioning unit of claim 4, wherein the means for conveying, further includes first and second transfer conduits integrally formed on the frame, for transferring fluid from the first chamber through the bore and into the second chamber.

7. The fuel conditioning unit of claim 1, wherein the frame has a substantially rectangular perimeter and said inlet port, outlet port, and drain port are formed in said perimeter.

8. The fuel conditioning unit of claim 1, wherein each of the first and second housings is self sealed except for aperture means formed in the portion of the respective housings that face a respective frame side, for interference sealing engagement with the respective conduits projecting from both frame sides.

9. The fuel conditioning unit of claim 1, further including a bracket means integrally formed on the frame.

10. The fuel conditioning unit of claim 1 further including a water level sensor in the lower portion of the first chamber.

11. The uel conditioning unit of claim 10 wherein the drain means includes a drain conduit projecting from the frame into the first chamber and the drain conduit is at a vertically higher elevation than the water level sensor.

12. The fuel conditioning unit of claim 11, wherein the drain port is fluidly connected to the source of fuel delivered to the inlet port.

13. The fuel conditioning unit of claim 1, further including vent means integrally formed in the upper portion of the frame, for venting air from the second chamber.

14. A fuel conditioning unit comprising:

a flow distribution frame having front, back, top, and bottom peripheral surfaces and first and second side surfaces;

a first housing securable to the first side of the frame and defining a first internal chamber adapted to contain a first type of separation element;

a second housing securable to the second side of the frame and defining a second internal chamber adapted to contain a second type of a separation element;

wherein the frame further includes, (a) a fuel inlet port accessible on the periphery of the frame and being fluidly connected with an inlet conduit projecting from the first side surface into the first chamber, (b) a fuel transfer conduit passing from the first side surface to the second side surface, (c) a filtered fuel conduit projecting from the second side surface and passing from the second chamber into the frame at a vertical elevation lower than that of the transfer conduit, (d) a fuel outlet port associated with the filtered fuel conduit and accessible on the frame periphery, and (e) a drain port in fluid communication with the first chamber and accessible on the frame periphery.

15. The fuel conditioning unit of claim 14, further including a vent port in fluid communication with the second chamber and accessible from the frame periphery.

16. The fuel conditioning unit of claim 15, wherein the drain port is in fluid communication with the first chamber through a drain orifice in the first chamber, the orifice being located at an elevation above the frame bottom.

17. The fuel conditioning unit of claim 16, wherein the first element separates water from fuel and the unit further includes means located in the first chamber below the drain orifice, for sensing the level of separated water.

* * * * *